United States Patent [19]

Herrig

[11] 4,130,971

[45] Dec. 26, 1978

[54] SET OF STRUCTURAL ELEMENTS FOR PRODUCING CUPBOARD WALLS AND OTHER WALL UNITS

[76] Inventor: Willi Herrig, Konrad-Adenauer-Str. 16, 5450 Neuwied, Fed. Rep. of Germany

[21] Appl. No.: 711,484

[22] Filed: Aug. 4, 1976

[30] Foreign Application Priority Data

Aug. 5, 1975 [DE] Fed. Rep. of Germany ... 7524787[U]
Dec. 2, 1975 [DE] Fed. Rep. of Germany ..... 2554113

[51] Int. Cl.[2] ..... A47B 57/00; F16B 5/07; E04H 1/00

[52] U.S. Cl. ..... 52/236.7; 52/236.9; 108/111; 108/114; 312/111; 312/263; 403/217

[58] Field of Search ..... 312/111, 263; 108/111, 108/114; 403/218, 217, 406, 407; 52/236.7, 236.6, 236.9, 285

[56] References Cited

U.S. PATENT DOCUMENTS

| | | | |
|---|---|---|---|
| 827,013 | 7/1906 | Haney | 52/234 X |
| 2,278,327 | 3/1942 | Magnus et al. | 46/25 |
| 2,568,133 | 9/1951 | Swisher, Sr. et al. | 52/285 X |
| 3,285,444 | 11/1966 | Reilly | 211/189 |
| 3,756,581 | 9/1973 | Albertini | 108/111 |
| 3,783,801 | 1/1974 | Engman | 108/111 |
| 3,841,052 | 10/1974 | Metz | 52/285 X |
| 3,873,219 | 3/1975 | Pofferi | 403/219 X |
| 3,874,753 | 4/1975 | Naito et al. | 312/263 X |
| 3,949,534 | 4/1976 | Croy et al. | 52/285 |
| 3,961,586 | 6/1976 | Bernard | 312/111 |

FOREIGN PATENT DOCUMENTS

| | | | |
|---|---|---|---|
| 108903 | 2/1968 | Denmark | 52/236.9 |
| 318158 | 2/1957 | Switzerland | 312/111 |

*Primary Examiner*—Alfred C. Perham
*Attorney, Agent, or Firm*—Walter Becker

[57] ABSTRACT

A set of structural elements for producing cupboard walls, cabinets, drawers, partitions and similar wall units, which includes pairs of first plate units and second plate units. The plates of each of the plate units can be arranged so that their plate units are in alignment with each other in such a way that one edge of one unit faces the adjacent edge of the other unit of one and the same type of plate units. Connecting members respectively connect the pairs of the first plate units to the pairs of the second plate units.

3 Claims, 36 Drawing Figures

Fig. 4
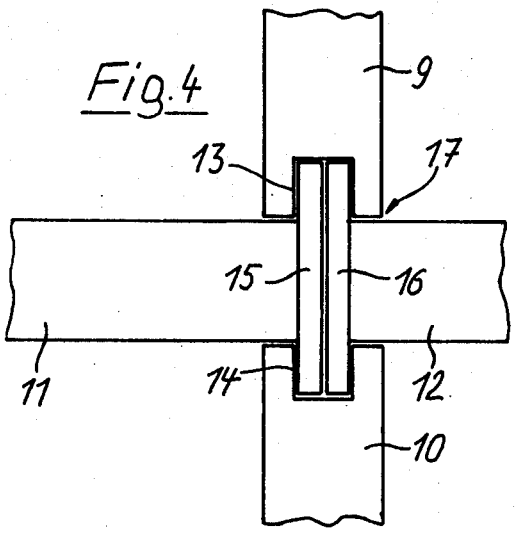
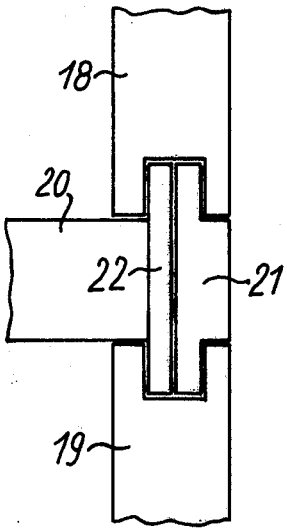
Fig. 5
Fig. 3
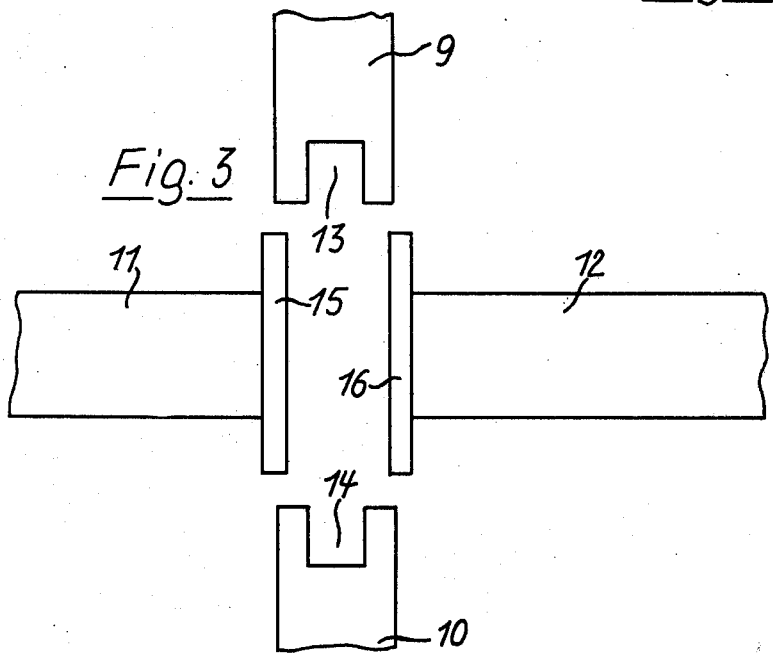

SET OF STRUCTURAL ELEMENTS FOR PRODUCING CUPBOARD WALLS AND OTHER WALL UNITS

The present invention relates to a set of structural elements for producing wall units, such as cupboards, wardrobes, and other structures. Various types of structural elements for the just mentioned purpose have become known. In particular, a set of structural elements for making walls of cabinets, cupboards, wardrobes, and other wall units, with open or closable compartments, shelving, and the like, having a rectangular opening and predetermined dimensions has become known according to which the plate elements having rectangular shape and consisting preferably of wood or a pressed wood material are adapted to be combined with each other and within the region of adjacent edges can be connected to each other by means of connecting elements. These connecting elements, on the one hand, consist of dovetailed grooves provided in the edges or the narrow sides of the plate elements and of dovetailed webs or extensions, on the other hand, so that two, three of four plate elements can be connected to each other in the above described manner by aligning the plates accordingly. Although the described heretofore known method has advantages over other methods for preparing and interconnecting sets of structural elements for producing wall units, all of the heretofore known methods of the type involved have the drawback that the wear of the tools used for producing the connecting elements and the grooves is relatively high so that the production costs of such sets of structural elements become correspondingly high.

It is, therefore, an object of the present invention to provide a set of structural elements for producing wall units of cupboards, cabinets, shelving, and similar structures, which will be characterized by low production costs and will have the advantage that the compartments, partitions and the like of such wall units can be composed in a simple manner in a minimum of time.

This object and other objects and advantages of the invention will appear more clearly from the following specification in connection with the accompanying drawings, in which:

FIG. 1 diagrammatically illustrates a front view of a possible wall unit composed of a set of structural elements according to the invention.

FIG. 2 diagrammatically and in front view shows a wall unit made up of modified structural elements according to the invention.

FIG. 3 shows four individual plate elements according to the invention placed relative to each other for connection for each other.

FIG. 4 illustrates the structural elements of FIG. 3 in interconnected condition.

FIG. 5 illustrates three structural elements in connected condition and in combination with a filling strip.

FIG. 6 shows plate elements in the region of a support or base provided for a cupboard wall or the like.

Figure 32A:
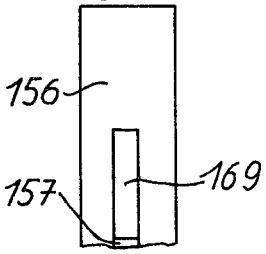
FIG. 32 shows the plate elements of FIG. 30 in an exploded view.
Figure 32:
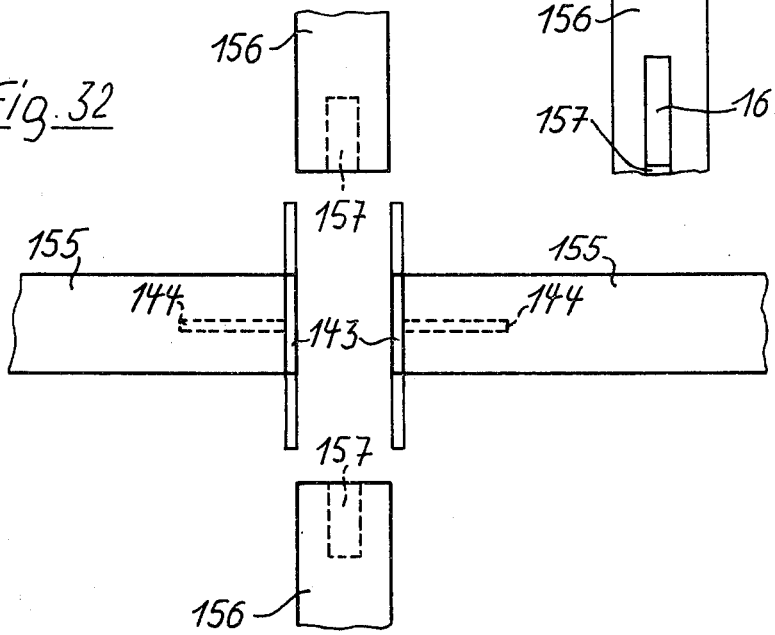

FIG. 32*a* is a top view of a plate element as illustrated in FIG. 32 but not provided with a semi-finished element.

Figure 33:
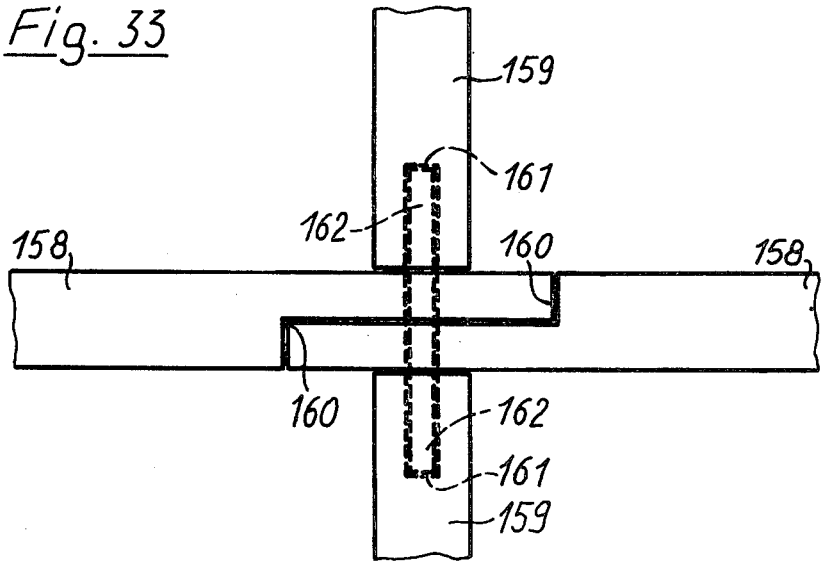

FIG. 33 represents still another possible embodiment of a connection of four plate elements in conformity with the present invention.

Figure 34:
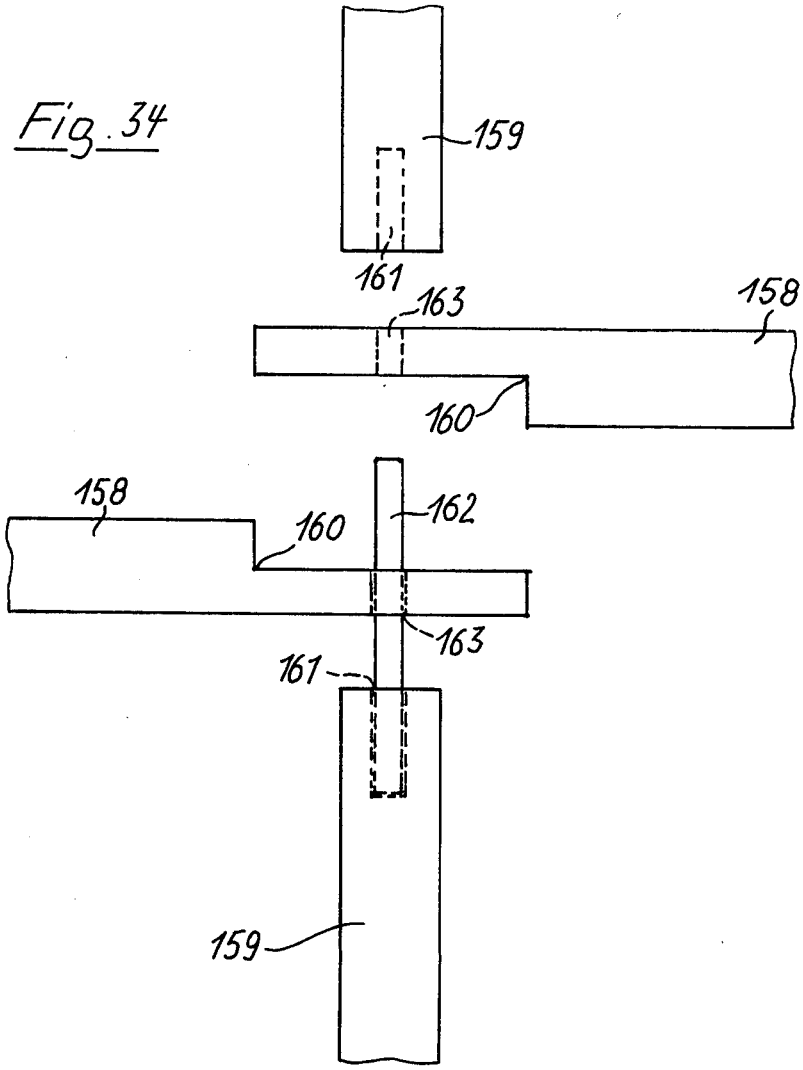

FIG. 34 shows the plate elements of FIG. 33 prior to and during the assembly thereof.

Figure 35:
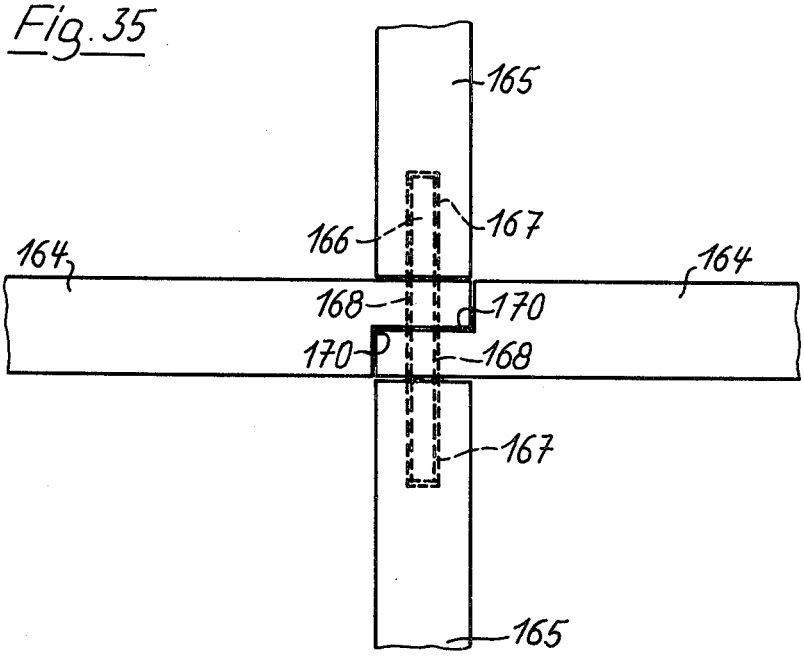

FIG. 35 shows a connection of four plate elements to each other which connection is slightly modified over that of FIG. 33.

The present invention is characterized primarily in that in those plate elements which are located opposite to each other and pertain to a drawer, compartment, or the like, grooves, recesses, bores or the like of predetermined dimensions and cross-sectional shape are provided at two oppositely located narrow sides of the plate elements which grooves, recesses, bores or the like correspond as to their dimensions and cross-sectional shapes to steps, keys, pegs, plugs, or the like which are connected or connectable to plate elements which are located opposite to each other and pertain to a drawer, compartment or the like while the connection or connectability is provided within the region of the narrow sides of the plate elements which narrow sides are located opposite to each other. The steps, keys, pegs, plugs or the like, when in connected condition, project from at least one of the planes of the wide sides of the plate elements and, more specifically, to an extent which corresponds to the depth of the grooves, recesses, bores, or the like.

Figure 1:
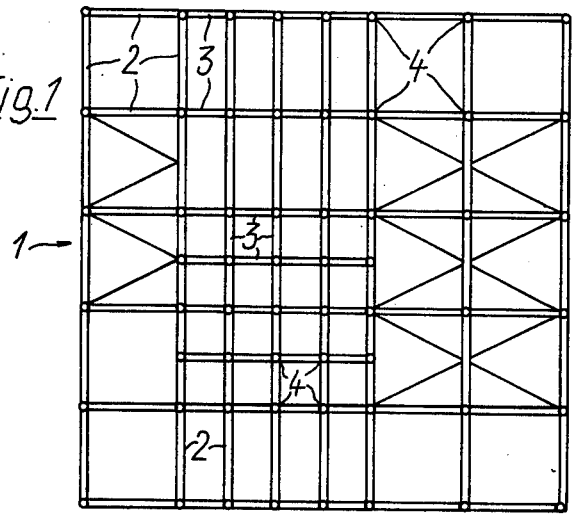

Referring now to the drawings in detail, FIG. 1 illustrates a cabinet wall unit, cupboard wall unit, or other wall unit 1 which in conformity with the present invention has been made up of differently sized plate elements 2 and 3. Within the region of the connecting areas 4, the individual plate elements 2 or 2 and 3 are connected to each other.

Figure 2:
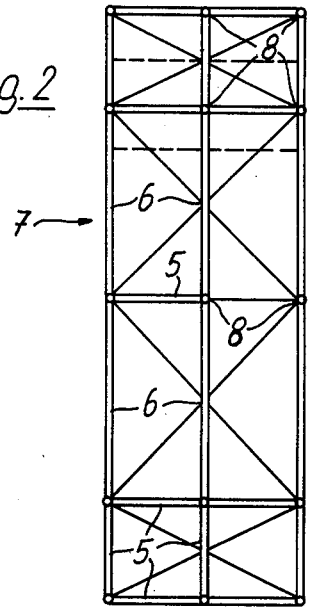

Another possible construction of wall units as set forth in the preceding paragraph is illustrated in FIG. 2. According to this unit, differently sized plate elements 5 and 6 have been combined or assembled to form a wall unit 7. The connecting areas of the individual plate elements as to each other are designated with the reference numeral 8. The connecting areas 8 may correspond to the connecting areas 4 in FIG. 1 and by way of example may be designed in conformity with FIGS. 4 and 5.

FIG. 3 shows plate elements 9, 10, 11 and 12 of which each pair of plate elements 9 and 10 and 11 and 12 are substantially identical to each other. While the plate elements 9 and 10 are within the region of two narrow sides located opposite to each other provided with grooves 13 and 14 respectively, the plate elements 11 and 12 are at two narrow sides located opposite to each other equipped with keys, strips or the like 15 and 16 respectively. The keys, strips or the like 15 and 16 preferably are made of wood, preferably hard wood, and expediently are firmly connected to the plate elements 11 and 12 respectively by gluing.

In FIG. 4, the plate elements 9–12 of FIG. 3 are shown in connected condition. The connection effected by means of grooves 13 and 14 and keys, strips or the like 15 and 16 is designated with the reference numeral 17. It will be seen that the plate elements 9–12 of the described connection are secured against accidental displacement relative to each other and laterally to each other.

With a connection of only three plate elements 18, 19 and 20 in conformity with the illustration of FIG. 5, expediently a filling strip 21 is employed. The filling strip 21 is as to its cross-sectional contour corresponding to the cross-sectional contour of the respective end region of the plate element 20 and the adjacent key, strip or the like designated with the reference numeral 22.

Figure 6:
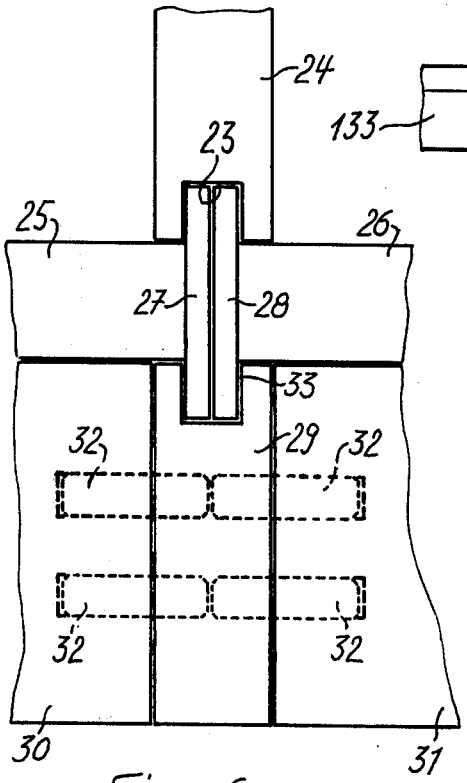

FIG. 6 shows plate elements 24, 25 and 26 which are located within the region of support elements 29, 30 and 31 of a wall unit. The groove 23 provided in the plate element 24 is engaged by one end of the keys, strips or the like 27 and 28 respectively located on the plate elements 25 and 26, whereas the other end of the keys, strips or the like 27 and 28 respectively engages a groove 33 located in the support element 29. The support element 29, similar to the plate elements 24–26, extends over the entire depth of the wall unit. In front of the support element 29 there are provided bores (not shown). In these bores there are located portions of pegs or plugs 32. These pegs or plugs 32 furthermore engage bores (not designated with a reference numeral) which are located in the support elements 30 and 31. In this way a support is obtained which extends along the entire respective wall unit.

Figure 7:
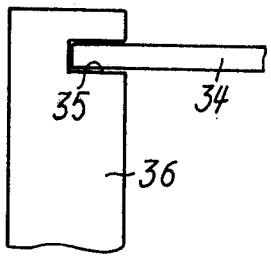
FIG. 7 illustrates a possible design of plate elements for the insertion of back walls.

For purposes of connecting further plate elements and for stabilizing a wall unit made up of such plate elements, rear walls 34 according to FIG. 7 may be provided for the individual compartments, partitions, or the like of the respective wall unit. The rear walls 34 are adapted to be inserted into grooves 35 of the plate elements 36.

Figure 8:
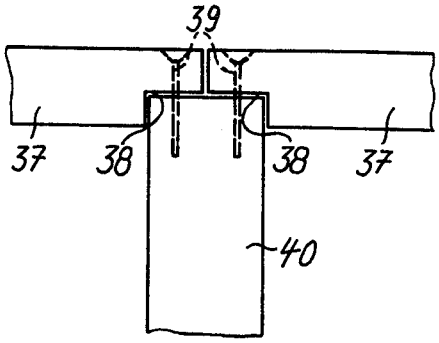
FIG. 8 illustrates another possible embodiment of a wall unit designed in conformity with the set of structural elements according to the invention.

According to the illustration of FIG. 8, it is possible to reinforce a wall unit by rear walls 37 which, in conformity with the inner dimensions of such compartments, partitions, or the like, are provided with a recess 38. The rear walls 37 may be connected to the plate elements 40 by means of suitable connecting means which may be nails 39.

Figure 9:
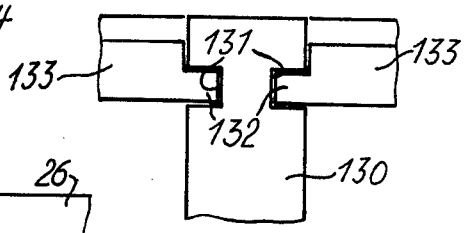
FIG. 9 represents a preferred embodiment of plate elements according to the invention together with a back wall to be connected to the plate elements.

Another possibility of reinforcing a wall unit according to the invention by means of rear wall elements is shown in FIG. 9. In this embodiment, the plate elements 130 may be provided with grooves 131 which are engaged by key-like extensions 132 of the rear wall elements 133.

Figure 10:
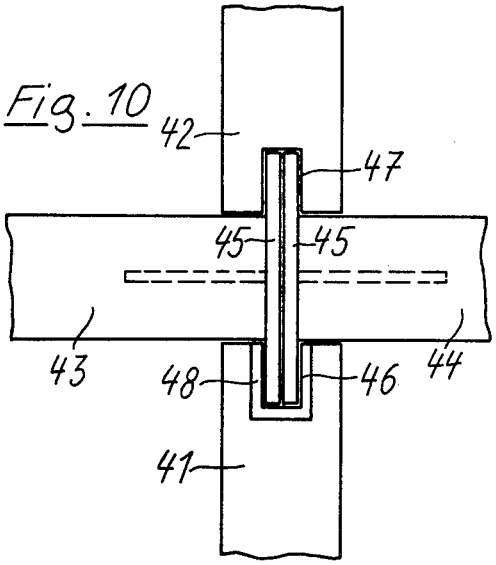
FIG. 10 shows a connection of four plate elements by means of suitably profiled metallic semi-finished elements.

According to the embodiment illustrated in FIG. 10, for purposes of connecting the plate elements 1–44, folded-over strips or T-shaped profiled (semi-finished elements) 45, preferably of aluminum, may be provided. The strips 45, similar for instance to keys 15 and 16 of FIG. 3, engage grooves 46 and 47 respectively of the plate elements 41 and 42. For various reasons, for instance for reasons of strength, it may be expedient to form a groove 46 by a correspondingly shaped profile (semi-finished element) which consists, for instance, of hard rubber and is inserted into a plate element 41. Such semi-finished element is shown for the plate element 41 and is designated with the reference numeral 48.

Figure 12:
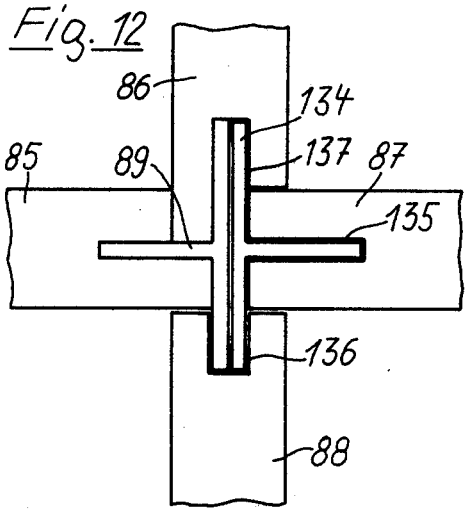
FIG. 12 represents still another possible way of connecting a total of four plate elements by means of suitably profiled metallic semi-finished elements.
Figure 11:
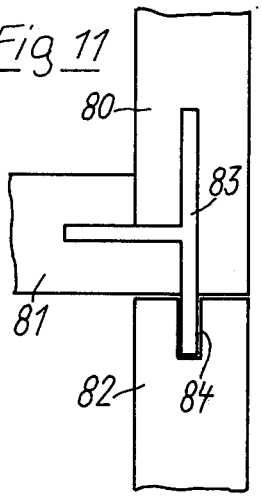
FIG. 11 illustrates another possible way of connecting three plate elements by means of metallic suitable profiled semi-finished elements.

FIGS. 11 and 12 show further possibilities for connecting plate elements to each other by means of semi-finished elements, for instance, made of aluminum.

According to FIG. 11, plate elements 80 and 81 arranged relative to each other at a right angle are together with a T-shaped aluminum profile 83 firmly connected to each other by gluing. That portion of the profile 83 which projects from the corner connection of the plate elements 80 and 81 extends into a groove 84 of the plate element 82.

The corner connection illustrated in FIG. 12 shows plate elements 85–88 of which the plate elements 86 and 85 together with a T-shaped profile 89 - similar to the connection of plate elements 80 and 81 of FIG. 11 - are firmly connected to each other by gluing. A further T-shaped profile 134 has its respective extensions engage grooves 135, 136 and 137 respectively of the plate elements 86, 87, 88.

Figure 13:
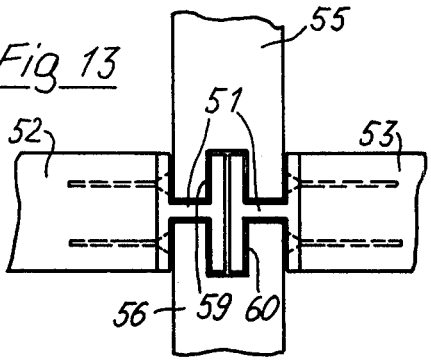
FIG. 13 shows the connection of three plate elements only by means of additional metallic semi-finished elements.
Figure 14:
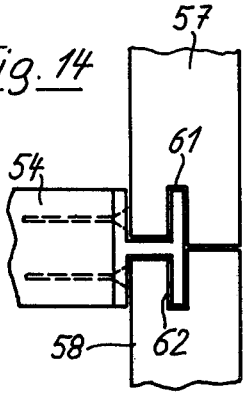
FIG. 14 illustrates a connection of only three plate elements by means of a metallic semi-finished element in conformity with the illustration of FIG. 13.

FIGS. 13 and 14 illustrate H-shaped semi-finished elements 51 which preferably are made of aluminum and which are firmly connected to the plate elements 52, 53 and 54 respectively, for instance, by screws. For connecting the plate elements 52 and 53 with the plate elements 55 and 56 respectively for connecting the plate element 54 to the plate elements 57 and 58, the respective free sections of the H-shaped semi-finished elements 51 engage grooves 59, 60 and 61, 62 respectively of the respective plate elements.

Figure 15:
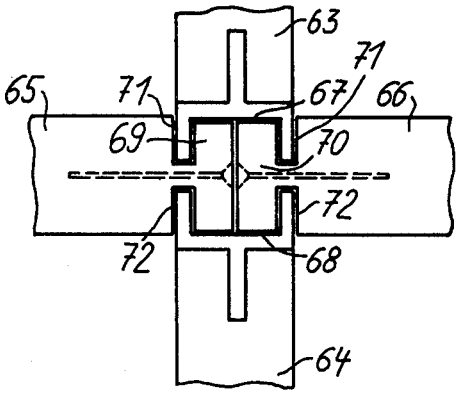
FIG. 15 represents the connection of four plate elements by means of suitably profiled metallic semi-finished elements for the formation of grooves in two of the plate elements to be connected to each other.

Another possibility to connect four plate elements 63–66 with each other is illustrated in FIG. 15. Firmly connected to the plate elements 63 and 64 are semi-finished elements which are preferably made of aluminum and which form grooves 67 and 68 respectively. The grooves 67 and 68 are engaged by keys 69 and 70 respectively which are provided on the plate elements 65 and 66 respectively and are formed by milling grooves 71 and 72 respectively into the plate element.

Figure 16:
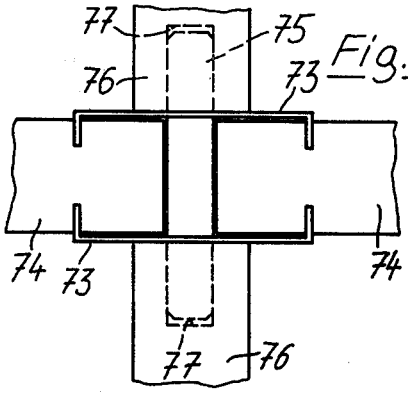
FIG. 16 shows still another possible connection of four plate elements.
Figure 17:
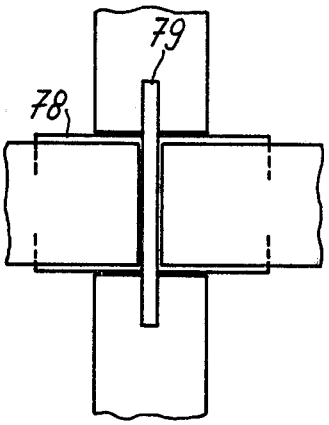
FIG. 17 represents a modification of the connection shown in FIG. 16 which modification likewise shows the interconnection of four plate elements.

FIGS. 16 and 17 illustrate further possibilities for a connection with each other of, in this instance, four plate elements.

FIG. 16 shows miter clamps 73 by means of which it is possible to interconnect plate elements 74 which are located opposite to each other and are arranged horizontally. The plate elements 74 are secured against accidental lateral displacement by pegs, plugs, pins, or short strips 75 which to a predetermined extent engage grooves 77 provided in the plate elements 76.

According to the embodiment illustrated in FIG. 17, the miter clamps 73 are, in conformity with FIG. 15, replaced by a corresponding semi-finished element 78, whereas the plugs or pegs or the like 75 have been replaced by metallic pins or the like 79.

Figure 18:
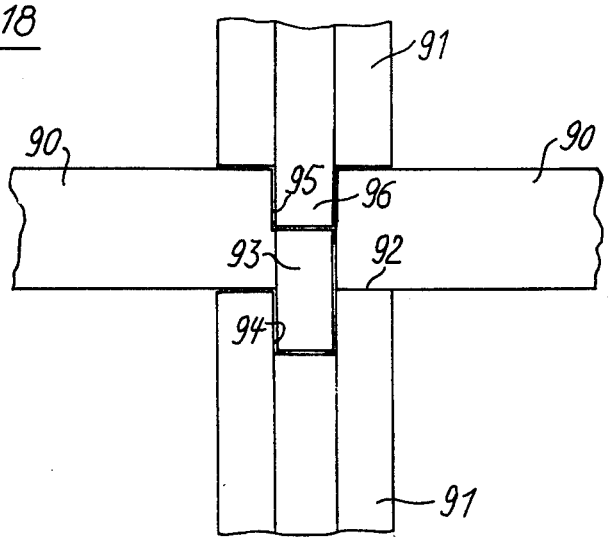
FIG. 18 represents still another modification of firmly interconnecting four plate elements which, however, are arranged at a right angle with regard to each other.

FIG. 18 shows another possibility of establishing a connection of two plate elements 90 and 91 which are vertically arranged with regard to each other; this connection may be effected already prior to the installation of a wall unit compartment. The plate elements 90 and 91 are within the region of the connecting area 92 firmly connected to each other by gluing or cementing. On that edge which faces away from the connecting area 92, a strip 93 is likewise by gluing or cementing firmly connected to a plate element 90. The strip 93 engages a groove 94 which is located within the region of the connecting area 92 in the plate element 91. Furthermore, between adjacent edges of the plate elements 90, in view of the strip 93 offset relative to the planes of the plate elements 90 with the strip 93 located between the plate elements 90, a groove 95 is formed which is engaged by a key 96 which is arranged in the respective edges of the plate elements 91.

Figure 19:
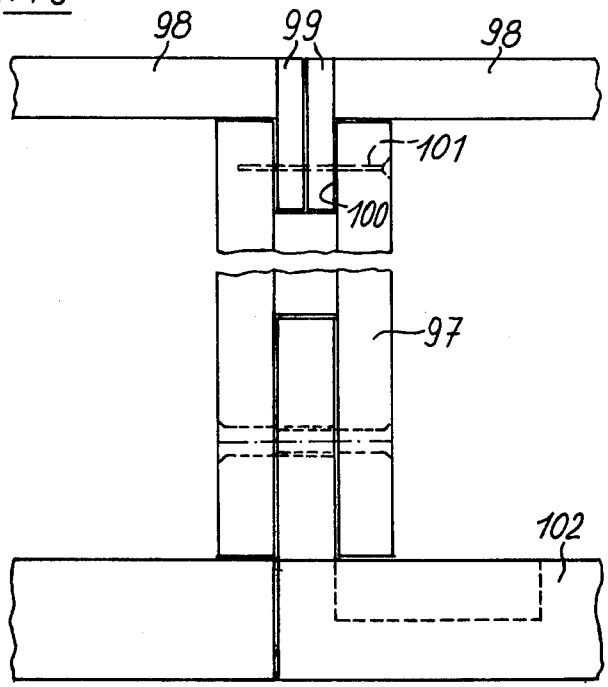
FIG. 19 shows the design and mounting of back walls and doors on wall units according to the invention.

According to FIG. 19, plate elements 97 may be provided with back walls 98 which are confined by strips 99. The strips 99 engage grooves 100 which are provided in the plate elements. For purposes of securing the position of the back walls 98, the back walls and plate elements 97 may be interconnected by means of screws 101. Furthermore, cabinet walls and the like built up by employing plate elements according to the invention may be provided with doors 102 as likewise shown in FIG. 19.

Figure 20:
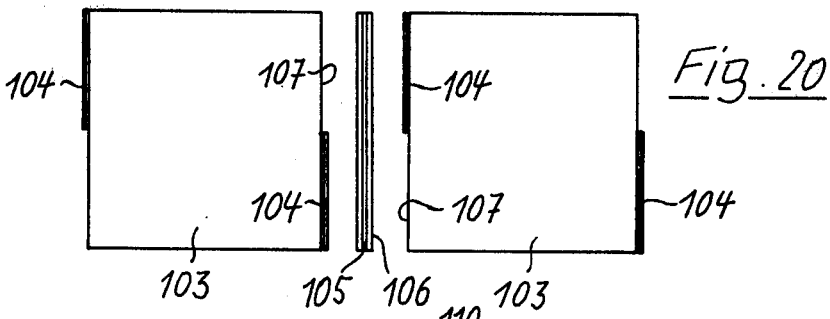
FIG. 20 shows a possible modification according to the invention in conformity with which the plate elements are interconnected by strip sections.

FIG. 20 shows plate elements 103 which are provided with strip sections 104. The strip section 104 extend as a maximum over half the longitudinal extension of the respective narrow sides of the plate elements 103 and as far as their thickness is concerned, they are adapted to the width of groove 105 in the plate elements 106. Opposite a strip section 104 of a plate element 103 there is provided a strip-free area 107 of the plate element.

Figure 21:
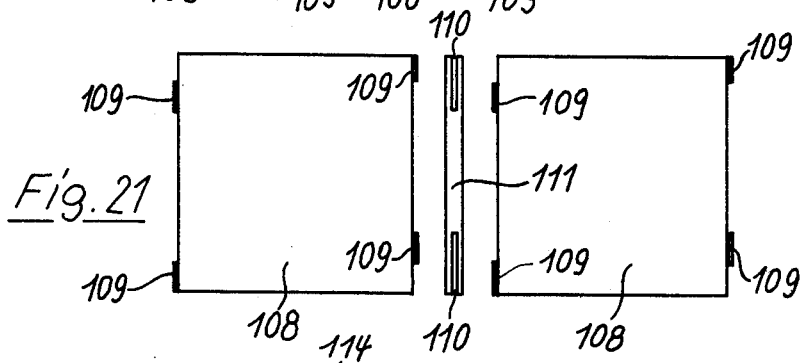
FIG. 21 shows a still further modification according to the invention according to which the plate elements are interconnected by pegs or pins.

The plate elements 108 shown in FIG. 21 are provided with pins or the like which are located at the narrow sides arranged opposite to each other. The pins 109 have a thickness which corresponds to the width of groove 110 in plate elements 111. Located opposite a pin 109 at a narrow side of a plate element 108 there is provided a pin-free area at the oppositely located narrow side of the respective plate element. The embodiment of the invention according to FIG. 21 can be realized at a relatively low expense and with a relatively low number of elements.

Figure 22:
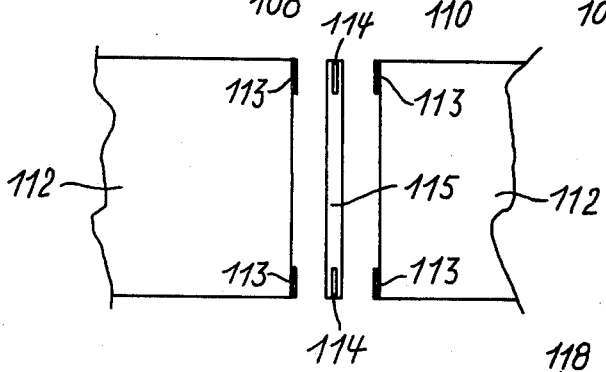
FIG. 22 illustrates a further modification of the invention according to which the plate elements, for purposes of connection to other plate elements provided with grooves, are equipped with pegs or pins which are uniformly distributed over the oppositely located narrow sides of the plates while the thickness of the pegs or pins amounts to about half the width of the grooves.

According to the embodiment of FIG. 22, the narrow sides of the plate elements 112, which narrow sides are located opposite to each other, have uniformly distributed thereover pegs or plugs 113 the thickness of which substantially corresponds to half the width of the groove 114 in plate elements 115. Also this embodiment of the invention has the advantage that a relatively small amount of material is needed for the production of the plate elements.

Figure 23:
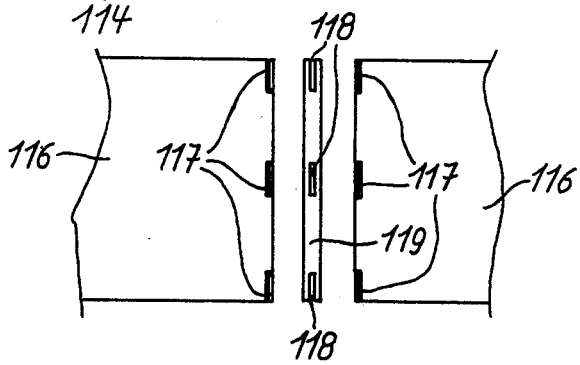
FIG. 23 shows still another modification of the invention with pegs, pins, or the like which are inserted in recesses provided in the narrow sides of the respective plate elements which narrow sides are located opposite to each other.

With the plate elements 116 illustrated in FIG. 23, projections 117 have been inserted into corresponding recesses (not further illustrated) which recesses are located in the narrow sides of the plate elements 116, the narrow sides being located opposite to each other. Similar to the arrangement of FIG. 22, the projections 117 have a thickness which at a maximum equals about half the width of groove 118 in the plate elements 119.

Figure 24:
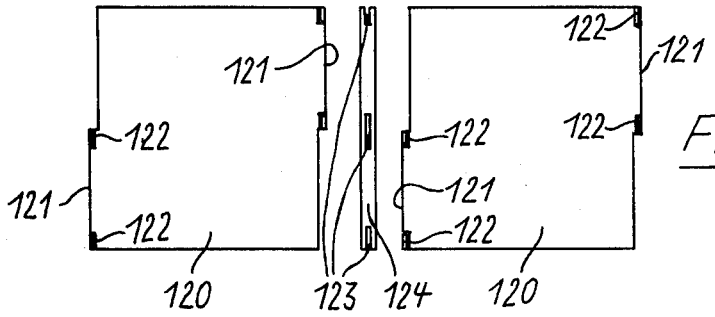
FIG. 24 illustrates still another possible embodiment of the invention with plate elements which have steps on their narrow sides located opposite to each other while pegs or the like are provided in the region of the steps.

The plate elements 120 illustrated in FIG. 24 have narrow sides located opposite to each other. The plate elements 120 respectively have a step 121 which extends at a maximum over half the length of the respective narrow side of the plate element 120 and of the recesses (not further indicated). Each of the steps 121 is provided with recesses which are not shown and which may be filled-in by pegs 122 firmly connected to the plate element 120. The pegs 122 have a thickness corresponding approximately to the width of groove 123 in the plate element 124 so that in assembled condition of the plate elements 120 and 124 the pegs 122 of the narrow sides located adjacent to each other and respectively pertaining to two plate elements 120 are aligned with each other.

Figure 25:
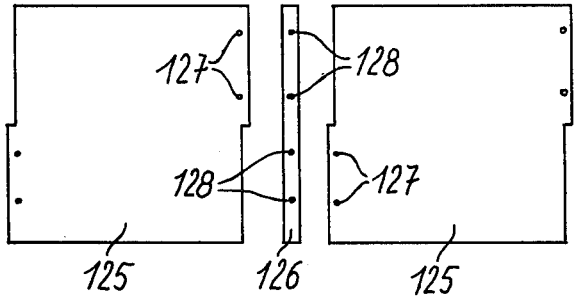
FIG. 25 shows a structure similar to that of FIG. 23 but with the difference that instead of the recesses bores are provided in which plugs or the like are connected.

FIG. 25 shows plate elements 125 and 126 which fundamentally correspond to the plate elements 120 and 124 of FIG. 24. With these plate elements 125 and 126, however, instead of recesses and pegs, bores and plugs 127 are provided in the plate elements 125, while in the plate elements 126 there are provided bores 128 which have a cross section corresponding to the plugs 127.

Figure 26:
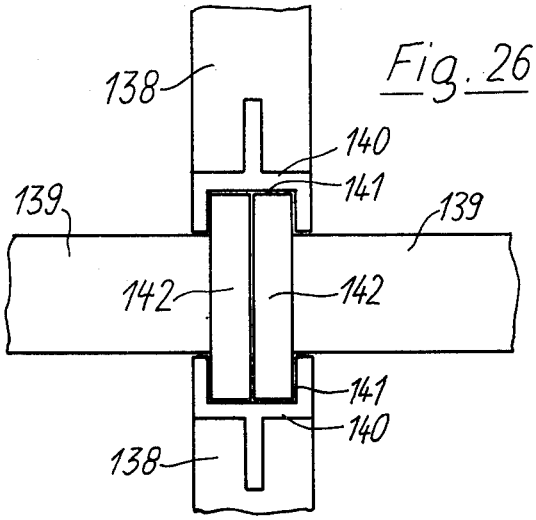
FIG. 26 shows a possible arrangement of plate elements according to the invention which is similar to that in the embodiment of FIG. 15.

The connection of the plate elements 138 and 139 shown in FIG. 26 is substantially similar to the connection of the plate elements of FIG. 15. The plate elements 138 are by gluing or cementing firmly connected to the strips 142. The edges of the strips 142 which are located opposite each other engage grooves 141 which are formed by profiles (semi-finished elements) 140. The profiles 140 are located on edges of the plate elements which edges are located opposite to each other.

Figure 27:
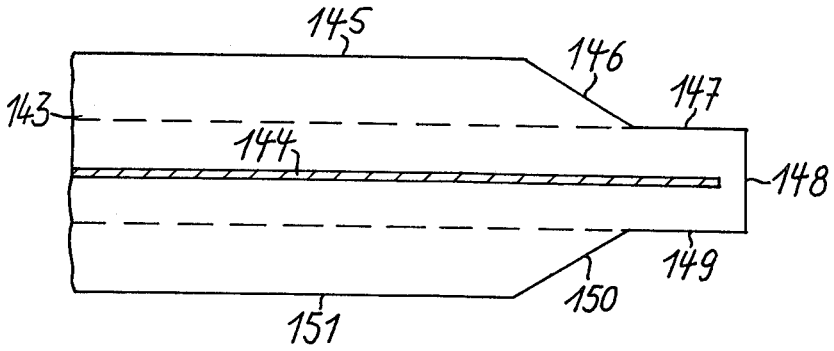
FIG. 27 illustrates a front view and section along the line XXVII—XXVII of FIG. 28 of a preferably employed profiled semi-finished element of metal, preferably aluminum.
Figure 28:
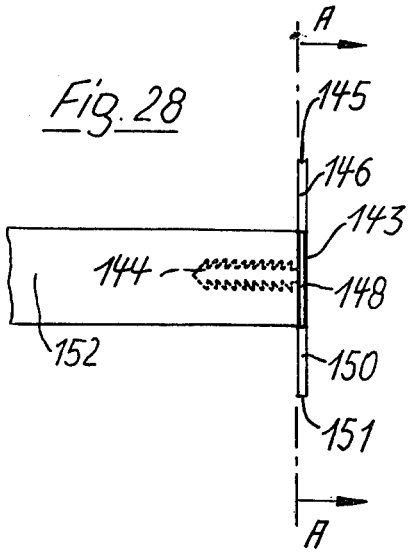
FIG. 28 shows the semi-finished element of FIG. 27 in side view and in connection with a plate element.

FIGS. 27 and 28 show a strip 143 which in the illustration of FIG. 28 is combined with a plate element 152; the strip 143 may consist of metal, preferably of aluminum. For purposes of effecting a connection in the plate elements 152 there is provided a web 144 which is equipped with non-illustrated barb-like extensions and which extends preferably over such length of a strip 143 that the edge 148 of strip 143 is still spaced from the respective adjacent end of web 144. In this way he web 144 will not be visible when the strip 143 is connected to a plate element 152. Furthermore, it is advantageous within the region of both ends of strips 143 so to design the strips 143 which consist of a T-shaped profile (semi-finished element) that those edges 145 and 151 which are located opposite to each other are within the region of the ends or edges 147 and 149 offset to the thickness of the respective plate elements 152. This set-back of the edges 145 and 151 respectively to the edges 147 and 149 may be effected by the edges 146 and 150 in a continuous manner. Within the region of the edges 147, 148 and 149, a strip 143 will then have a width which corresponds to the thickness of the plate elements 152. Accordingly, the grooves 157 provided in the plate elements 156 (FIGS. 30–32) need not extend over the entire length of a narrow side of the respective plate elements 156 but in adaptation to the extension of the edges 145, 146 and 150, 151 respectively of the strips 143 may be dimensioned and set back correspondingly. This has the advantage on the one hand that with plate elements composed by means of strips 143, only the edges 148 (see FIG. 30) remain visible while on the other hand by shaping the grooves in the plate elements 156 correspondingly, a certain centering of the strips 143 in the grooves 157 will be effected and the strips 143 will be secured against longitudinal displacement in the grooves 157.

Figure 29:
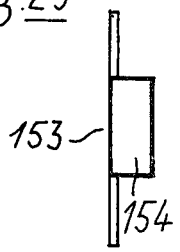
FIG. 29 represents a filling strip used in connection with the semi-finished elements of FIG. 27, which filling strip, as far as its function is concerned, corresponds to the filling strip shown in FIG. 7.

FIG. 29 shows a filling strip 153 with a central section 154. This filling strip corresponds in its function to the filling strip 21 of FIG. 5.

Figure 30:
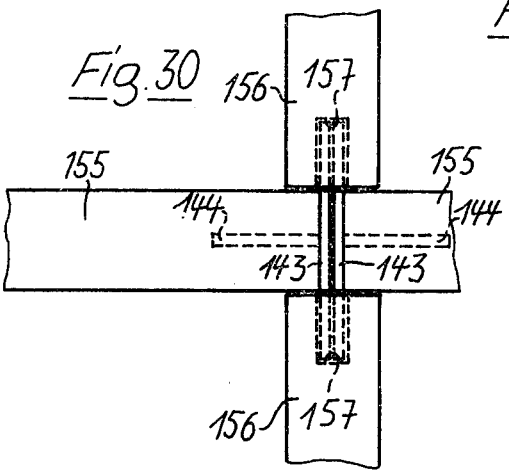
FIG. 30 shows the connection of four plate elements to each other by means of semi-finished elements in conformity with the showing of FIG. 27.
Figure 31:
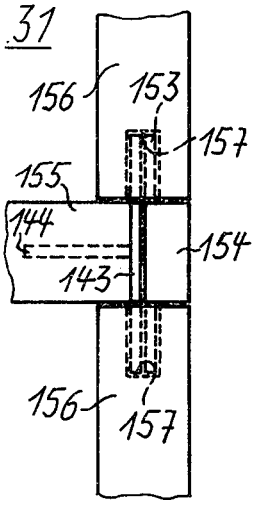
FIG. 31 represents a connection of three plate elements while employing a semi-finished element in conformity with FIG. 27 and while employing a filling strip in conformity with the illustration of FIG. 29.

FIGS. 30–32 respectively illustrate plate elements 155 and 156 in assembled condition and prior to their assembly. The showing of FIG. 31 comprises a filling strip 154 in case three plate elements are to be interconnected.

FIG. 32*a* shows a portion of a plate element 156 in top view. From the illustration of FIG. 32*a* it will be seen how a groove 157 may be designed for purposes of adapting the same to the extension of the edges 146, 145 and 150, 151 respectively of strips 143. With the plate elements 156 the inclined edges 169 which close the grooves 157 toward their ends correspond to the inclined edges 146 and 150 of the strips 143.

FIGS. 33 and 34 show the interconnection of plate elements 158 and 159. While FIG. 33 illustrates the plate elements 158 and 159 in interconnected condition, the plate elements 158 and 159 of FIG. 34 are in a condition in which they are separated from each other.

The plate elements 158 according to FIGS. 33 and 34 have rabbet sections 160 which permit a substantially closed connection or assembly of corresponding edges of plate elements 158. Within the region of the folded-over sections 160 and in the plate elements 158 there are provided bores 163 which, when the plate elements 158 are connected to each other, are in alignment with each other as shown in FIG. 33. The plate elements 159 which are to be arranged perpendicular to the plate elements 158 are provided with bores 161 which, as far as their diameter is concerned, correspond to the bores 163; for purposes of interconnecting the plate elements 158 and 159, there are provided pegs or the like which fill the bores 161 and 163.

The embodiment of the plate elements shown in FIG. 35 corresponds substantially to the embodiment of FIGS. 33 and 34. In contrast to the embodiments of FIGS. 33 and 34, the folded-over portions 170 which are located in the plate elements 164 have a shallower depth so that the separating areas between the plate elements 164 arranged adjacent to each other are respectively located in a plane with one side of a plate element 165, and therefore, are for all practical purposes not visible. The plate elements 164 and 165 are in this instance connected to each other by pegs 166 which fill the bores 167 provided in the plate elements 165 and also fill the bores 168 provided in the plate elements 164.

As will be evident from the above, the solution for producing a set of structural elements for the building-up of cabinet wall units, cupboard wall units, shelving, etc. brings about the advantage that the corresponding connecting elements for establishing a connection between at least two, usually four, plate elements, are extremely simple and thus affect the manufacturing costs to a much lesser degree than is the case with the heretofore known set of structural elements. In addition thereto, a cabinet wall unit or the like can be assembled by an unskilled person in a minimum of time while employing the structural elements according to the invention. It will also be evident from the above that the strips, keys, pegs, plugs, or the like are connected by gluing or cementing to the corresponding plate elements. In order, on the one hand, to be able to employ uniform plate elements and, on the other hand, to obtain a stable build-up of a cabinet wall unit or the like and also for obtaining a pleasing exterior of the wall unit according to the invention, it is possible to provide a filling strip in case only three plate elements are to be interconnected two of which are provided with grooves.

It will furthermore be evident from the above that the strips, keys, pegs, tenons and the like may be designed as profiled semi-finished elements of metal. Similarly, the grooves may be confined by suitably profiled semi-finished elements made of metal.

Furthermore, two plate elements arranged at a right angle with regard to each other may already prior to the assembly of the wall unit be firmly connected to each other so that the assembly of such wall unit will be greatly simplified.

It will also be seen from the above that it is possible to build up the cabinet wall unit or similar wall unit by means of a set of structural elements according to the invention without resorting to or employing back walls and/or doors. However, for the stability of an assembled wall unit it is advantageous to prepare the plate elements for receiving at least back plates and, if desired, also doors. This may be done, for instance, by providing grooves and folded-over portions in the region of those narrow sides of the plate elements which face away from an observer of the fully installed wall unit so that the back walls or plates can be put in place.

It will also be evident from the above the plate elements of compartments, cabinets or the like which are located opposite to each other may be at their narrow sides located opposite to each other each be provided with a strip section, for instance of wood, which is not longer than half the depth of the respective plate element. The arrangement is such that a strip section 104 on one narrow side of the plate element 103 has at the oppositely located narrow side of the other plate element 103 associated therewith a corresponding strip-free section 107 arranged directly opposite a strip section 104.

It will also be evident from the above that the narrow sides of the plate elements 108 which narrow sides are located opposite to each other have one or more tenons 109 which are so arranged that in assembled condition of the plate elements 101 the tenons on the narrow side of one plate element are in alignment with the tenons 109 of the oppositely located narrow side of a plate element 108.

It is, of course, to be understood that the present invention is, by no means, limited to the specific showing in the drawings but also comprises any modifications within the scope of the appended claims.

What I claim is:

1. A kit of interrelated component structural elements for quickly producing cupboard wall units, cabinet units, drawers, partitions, shelving and similar wall units, which includes in combination: a pair of first plate means adapted to be arranged in alignment with each other so that one edge of one of said first plate means faces a corresponding edge of the other one of said first plate means, each of said first plate means being provided with a groove, second plate means adapted to be arranged solidly at a substantially right angle to said first plate means, and strips connected to said second plate means and positively engageable with said grooves and operable to interconnect said first and second plate means, each of said strips being T-shaped metallic profiled semi-finished elements having edges located opposite to each other and set back within the region of the ends of said elements up to the extent of the thickness of the respective plate means.

2. A kit comprising structural component elements including panels having edges of equal length, first elements each having a groove in one edge, said groove extending less than the length of said edge so that it does not extend through adjoining edges, second elements each having a strip fixed along one edge, said strip being wider than the thickness of the element between its ends with the wider portion shorter than the length of said edge and equal to the length of the grooves in said first elements, said grooves being twice as wide as the thickness of said strips, so that a first element with a groove along one edge may receive the wider portions of two strips on two second elements to connect said elements, with said groove and wide portions of said strips being confined within the adjoining edges of the first element.

3. A kit as claimed in claim 2, in which the strips on said second elements are provided with wide portions extending beyond both surfaces of said second elements so that two of said first elements may be connected to two of said second elements, with said first elements at right angles to said second elements and said wide portions on opposite sides of said second elements engaging in grooves in the first elements.

* * * * *